US009844240B2

(12) United States Patent
George

(10) Patent No.: US 9,844,240 B2
(45) Date of Patent: Dec. 19, 2017

(54) SNAP SANDALS

(76) Inventor: Richard George, Surprise, AZ (US)

( * ) Notice: Subject to any disclaimer, the term of this patent is extended or adjusted under 35 U.S.C. 154(b) by 1154 days.

(21) Appl. No.: 13/480,276

(22) Filed: May 24, 2012

(65) Prior Publication Data

US 2012/0311889 A1 Dec. 13, 2012

Related U.S. Application Data

(60) Provisional application No. 61/495,916, filed on Jun. 10, 2011.

(51) Int. Cl.
*A43B 3/12* (2006.01)
*A43B 3/24* (2006.01)
*A43B 3/10* (2006.01)

(52) U.S. Cl.
CPC ..... *A43B 3/103* (2013.01); *A43B 3/126* (2013.01); *A43B 3/242* (2013.01)

(58) Field of Classification Search
USPC ..... 36/11.5, 1, 101, 135, 100
See application file for complete search history.

(56) References Cited

U.S. PATENT DOCUMENTS 2,595,643 A * 5/1952 Daugherty, Jr. ..... 36/11.5
3,121,962 A * 2/1964 Gullo ..... 36/11.5
7,222,441 B2 * 5/2007 Smith et al. ..... 36/11.5
7,681,330 B2 * 3/2010 Lewis ..... 36/11.5
2002/0124433 A1 * 9/2002 Pan ..... 36/11.5
2008/0022557 A1 * 1/2008 Hearn ..... 36/94
2008/0052958 A1 * 3/2008 Pan ..... 36/11.5
2008/0060227 A1 * 3/2008 Enderson ..... 36/100
2008/0110054 A1 * 5/2008 Lewis ..... 36/101
2009/0044423 A1 * 2/2009 Amsterdam ..... 36/11.5
2009/0133289 A1 * 5/2009 Cantoni ..... 36/101
2009/0260260 A1 * 10/2009 Whitaker et al. ..... 36/101
2010/0212184 A1 * 8/2010 Rudd et al. ..... 36/11.5

* cited by examiner

*Primary Examiner* — Katharine Gracz

(57) ABSTRACT

An apparatus for sandals with interchangeable upper section consists of an upper portion, a sole, and a securing system. The upper portion is the only interchangeable component, and users can interchange different upper portions with one specific sole. The securing system consists of a plurality of male connectors and a plurality of female connectors. The plurality of male connectors is connected with the sole, and the plurality of female connectors is connected with the upper portion. The upper portion can be attached to the sole, when the plurality of female connectors is traversed into the plurality of male connectors. The apparatus for sandals with interchangeable upper section consists of many different colors and styles in order to complement a wide variety of customers.

6 Claims, 6 Drawing Sheets

SNAP SANDALS

The current application claims a priority to the U.S. Provisional Patent application Ser. No. 61/495,916 filed on Jun. 10, 2011.

FIELD OF THE INVENTION

The present invention relates generally to an apparatus for covering the sole of the feet. More specifically, the present invention is a sandal that have a sole and an interchangeable upper portion that are secured by a pair of securing means.

BACKGROUND OF THE INVENTION

Generally, sandals are made in various materials and styles. Consumers must buy two pairs sandals in order to enjoy two different styles of sandals. However, this can be expensive both for the consumer and the manufacturer, the latter of which must produce a large quantity of sandals every year to keep up with consumer demand. As a result, not only is the current method expensive, it is also harmful to the environment due to the extended production time and use of raw materials. It is therefore an object of the present invention to provide an apparatus that saves capital and raw materials by utilizing an interchangeable configuration that allows users to change the style and material of the sandal. The present invention helps the consumer as well as the manufacturer in cutting down financial expenditure, and it is also environmentally friendly as it uses less raw materials, less energy, and less production time during the production. The user of the present invention is able to enjoy different styles of sandals for a lower cost, and he/she will be able to easily mix and match different colors and designs of the present invention.

DETAILED DESCRIPTIONS OF THE INVENTION

All illustrations of the drawings are for the purpose of describing selected versions of the present invention and are not intended to limit the scope of the present invention.

Figure 1:
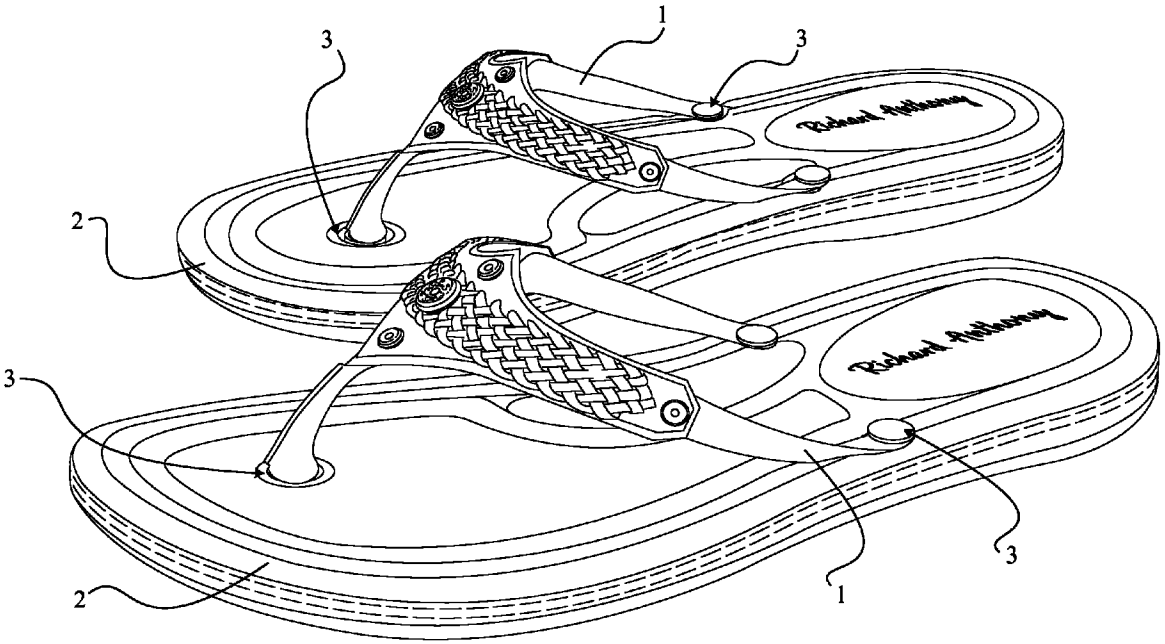
FIG. 1 is a perspective view of a first embodiment of the present invention.
Figure 2:
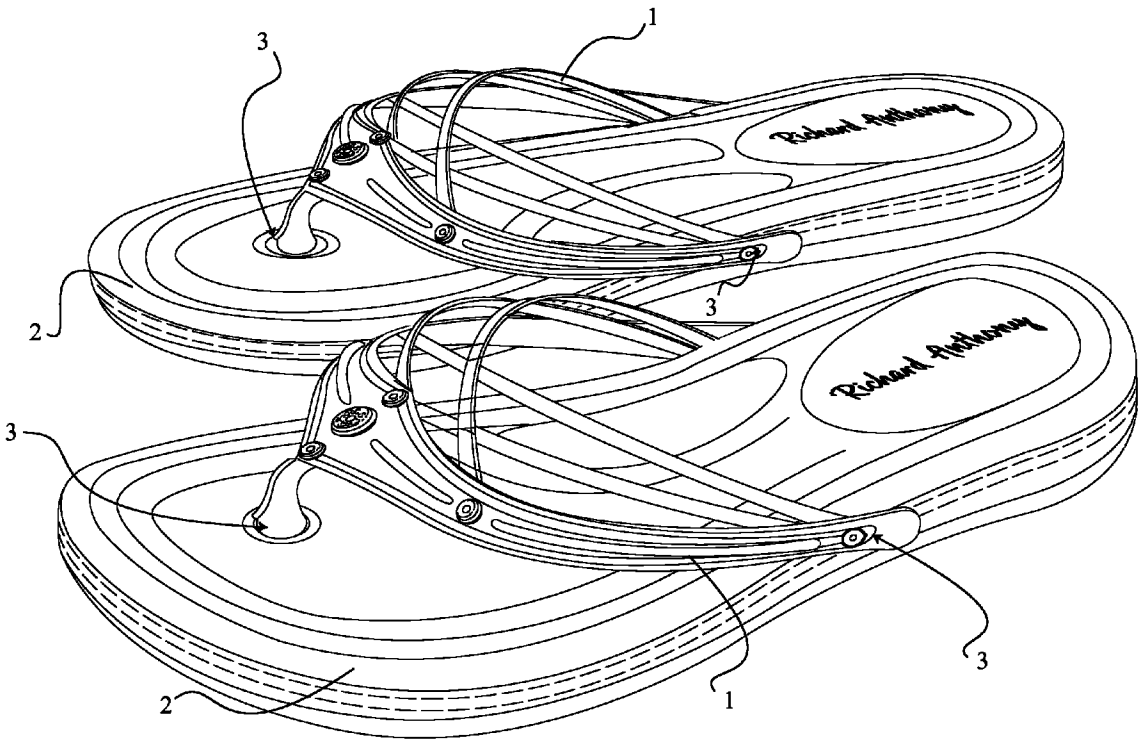
FIG. 2 is a perspective view of a second embodiment of the present invention.

In reference to FIG. 1 and FIG. 2, the present invention is an apparatus for a sandal which comprises an interchangeable component. The present invention comprises an upper portion 1, a sole 2, and a securing system 3. The present invention comprises only one interchangeable component which is the upper portion 1, and the upper portion 1 interchangeably connects with the sole 2 by the securing system 3. Because of the interchangeable component, the connection process of the upper portion 1 and the sole 2 is much simpler. The present invention can be any color or size depending on the design and the style of the sole 2 and the upper portion 1. The upper portion 1 is designed to be positioned around the user's feet for enhanced placement so that the user can comfortably wear the present invention while covering the dorsum area of the foot. The sole 2 is designed to be comfortably positioned under the planum area of the foot that faces downward while standing. The upper portion 1 and the sole 2 may be composed of, but not limited to, flat, thick, formed, soft, or hard material such as leather, rubber, cloth, gel, or any other related materials. Interchanging of the upper portions 1 provides a customize look for the sandal with reference to users preference. Since the upper portion 1 of the present invention is interchangeable, a user of the present invention can match the color of their sandals with consideration towards their preference, which may be to coordinate with their apparel. The present invention creates a series of soles 2 by which specific upper portions 1 would be designed to accompany a specific sole 2.

The securing system 3 is a male and female snap system whereby the upper portion 1 can be snapped into the sole 2 and snapped out of the sole 2 to change the upper portion's 1 look and design. The size and color of the securing system 3 is determined by the sole 2 and design of the upper portion 1. For example, the securing system 3 is not visible to human eye when the upper portion 1 is attached to the sole 2. The securing system 3 comprises a plurality of male connectors 31 and a plurality of female connectors 32. The plurality of female connectors 32 is connected to the upper portion 1, and the plurality of male connectors 31 is connected to the sole 2. The plurality of male connectors 31 comprises a first male connector 311, a second male connector 312, and a third male connector 313, and the plurality of female connectors 32 comprises a first female connector 321, a second female connector 322, and a third female connector 323. When the upper portion 1 is attached to the sole 2, the first female connector 321, the second female connector 322, and the third female connector 323 are respectively aligned with the first male connector 311, the second male connector 312, and the third male connector 313. The plurality of female connectors 32 and the plurality of male connectors 31 can be made from stainless steel or any other type of high strength corrosion free materials to improves the reliability of the present invention.

Figure 3:
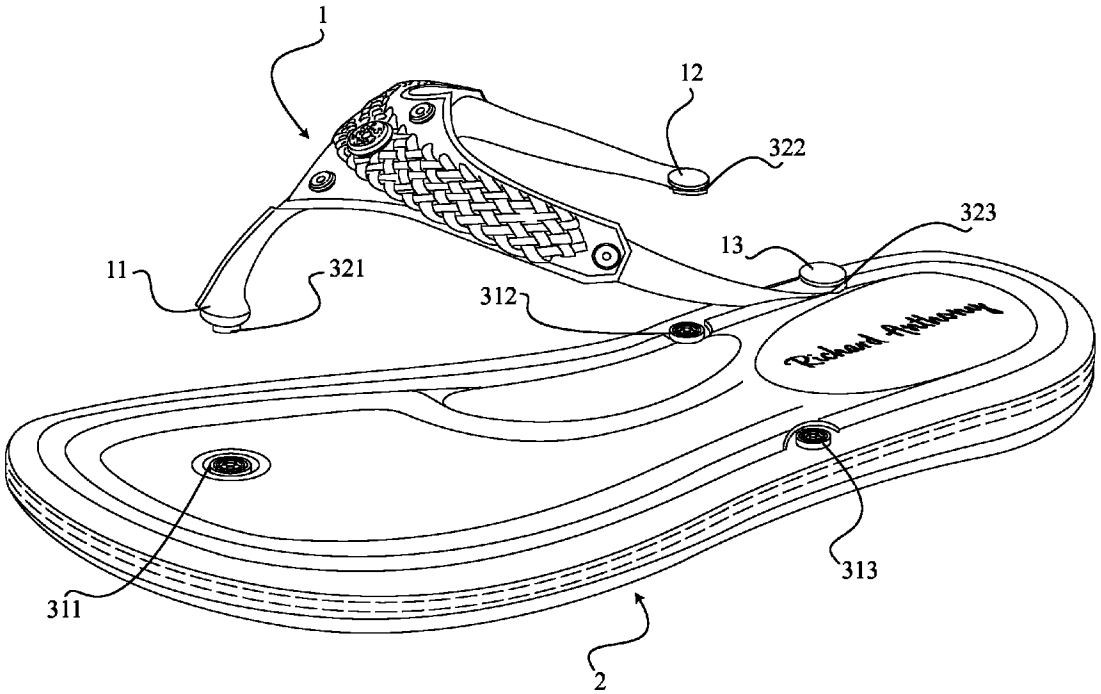
FIG. 3 is a perspective view of the first embodiment showing an upper portion being separated from a sole.

In reference to FIG. 3, the upper portion 1 comprises a first end 11, a second end 12, and a third end 13. In the present invention, the first end 11 is positioned in between the second end 12 and the third end 13 and located away from the second end 12 and the third end 13. The second end 12 and the third end 13 are adjacently positioned from each other. When the users wear the present invention, the first end 11 positions in between the user's big toe and second toe, and the second end 12 and the third end 13 respectively position around the inner arch and the outer arch. Since upper portion 1 is the interchangeable component of the present invention, the upper portion 1 can be made into different styles and colors to attract a wider market range, and the upper portion 1 can also be personalized according to the customers. Inside surface of the upper portion 1 can be accompanied with visco-elastic polyurethane foam to improve the user's comfort.

Figure 5:
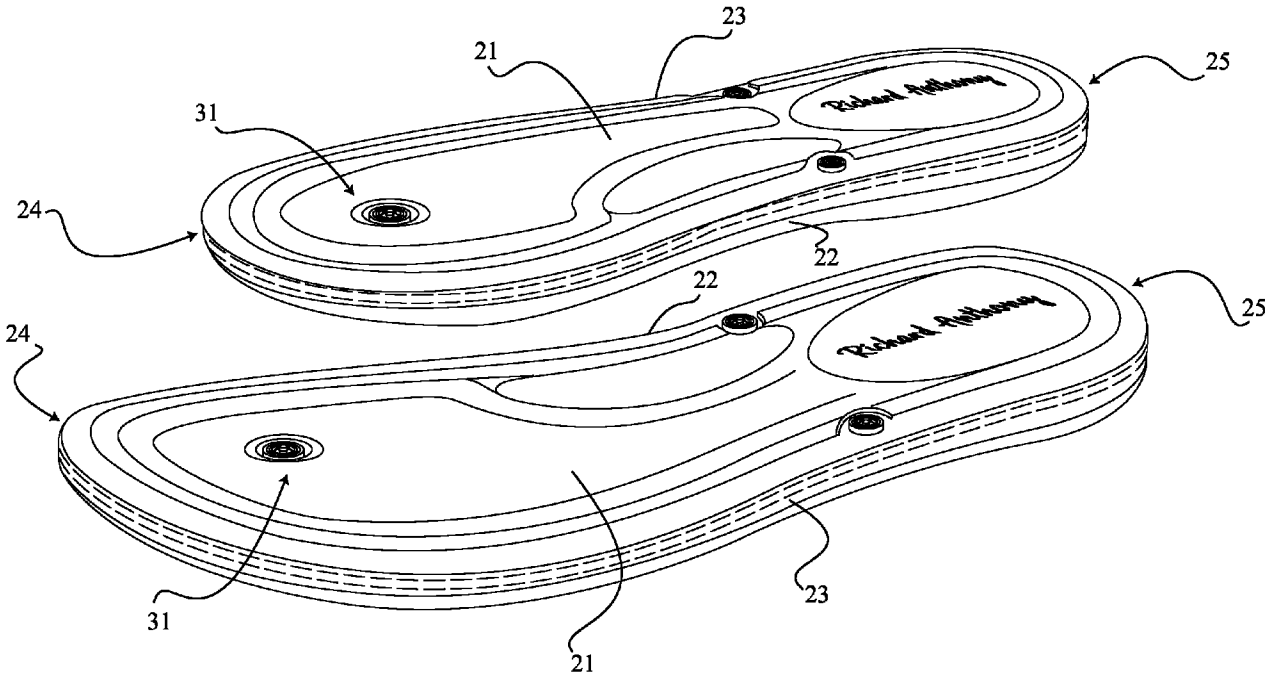
FIG. 5 is a perspective view of the first embodiment's sole.
Figure 6:
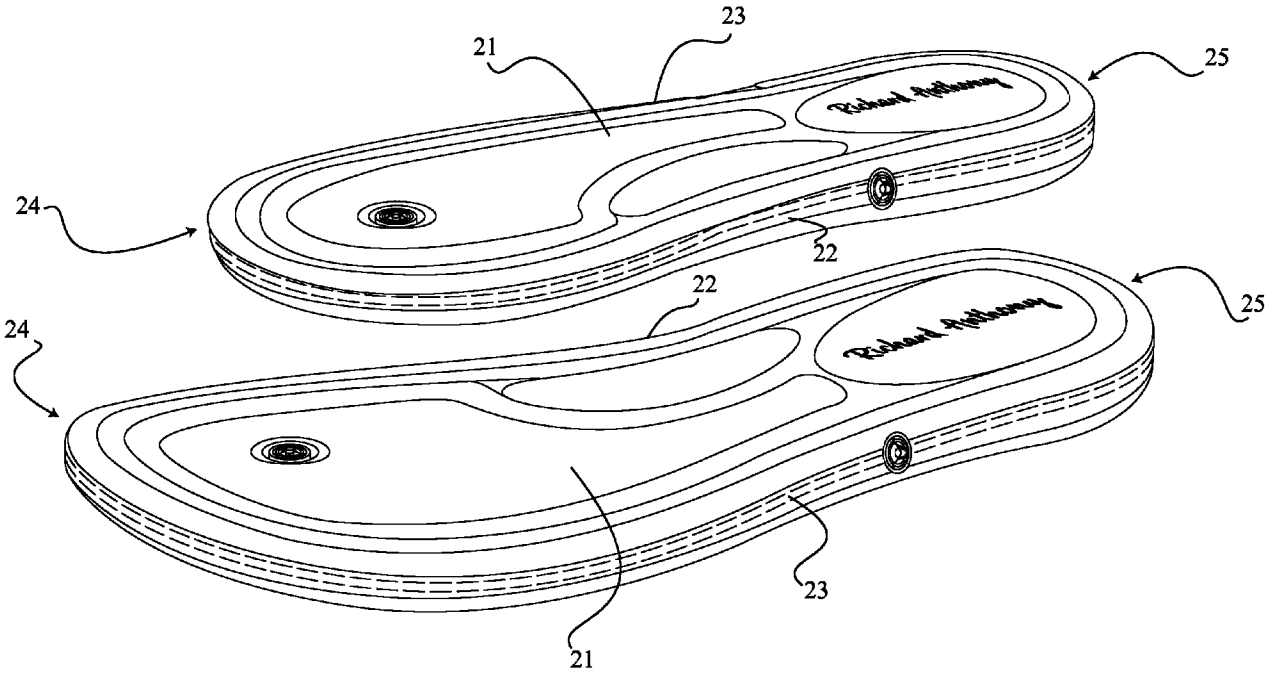
FIG. 6 is a perspective view of the second embodiment's sole.

In reference to FIG. 5 and FIG. 6, the sole 2 comprises a top panel 21, an inside panel 22, an outside panel 23, a front portion 24, and a back portion 25. The top panel 21 positions under the user's foot while the front portion 24 positions under the user's toe and the back portion 25 positions under the user's heel. The top panel 21 may comprises a layer of visco-elastic polyurethane foam to improve the comfort of the user's feet so that the top panel 21 deforms according to the user's feet. The inside panel 22 positions facing toward the opposite left or right leg of the user and adjacent with the user's inner arch. The outside panel 23 positions away from the left leg or the right leg of the user and adjacent with the user's outer arch. The inside panel 22 and the outside panel 23 are perpendicularly connected with the top panel 21. The sole 2 can comprise different styles, such as a flat heel, wedge or heel of any height, and different colors to accommodate all desirable customers. The back portion 25 of the top panel 21 can be used to print a trademark, brand name or different style names of the present invention so that the user can avoid confusion between different styles.

The present invention comprises a first embodiment and a second embodiment. The main difference between the first embodiment and the second embodiment is the positioning of the plurality of male connectors 31 and the plurality of female connectors 32.

In reference to FIG. 3 and FIG. 5, the first embodiment's second male connector 312 and third male connector 313 are connected to the top panel 21 in between the front portion 24 and the back portion 25. The first male connector 311 is connected to the top panel 21 from the front portion 24. The first female connector 321, the second female connector 322, and the third female connector 323 are respectively connected to the first end 11, the second end 12, and the third end 13. In the first embodiment, the first end 11, the second end 12, and the third end 13 are formed into a parallel position with the top panel 21 so that the securing system 3 delivers optimal performance when the first embodiment is used. When users need to change the upper portion 1 of the first embodiment, they can simply snap out the existing upper portion 1 and snap on a different upper portion 1.

Figure 4:
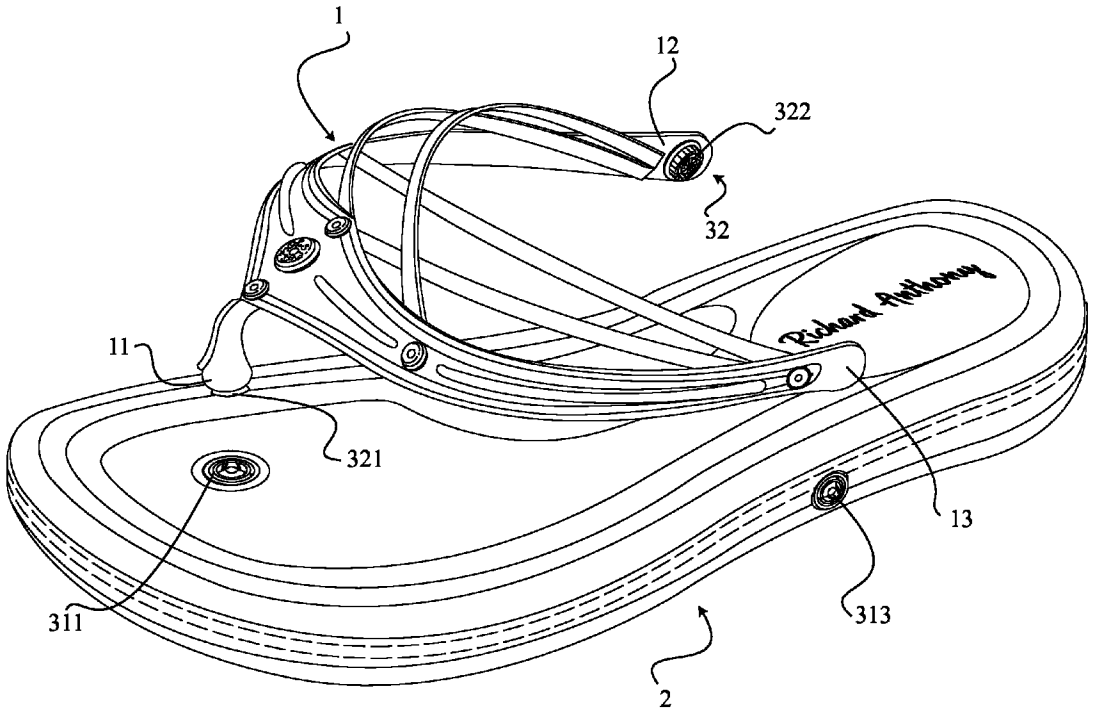
FIG. 4 is a perspective view of the second embodiment showing the upper portion being separated from the sole.

In reference to FIG. 4 and FIG. 6, the second embodiment's second male connector 312 and the third male connector 313 are respectively connected to the inside panel 22 and the outside panel 23 in between the front portion 24 and the back portion 25. The first male connector 311 is connected to the top panel 21 from the front portion 24. The first female connector 321, the second female connector 322, and the third female connector 323 are respectively connected to the first end 11, the second end 12, and the third end 13. In the second embodiment, the first end 11 is formed into the parallel position with the top panel 21, but the second end 12 and the third end 13 are formed into a parallel position with the inside panel 22 and the outside panel 23. When users need to change the upper portion 1 of the second embodiment, they can simply snap out the existing upper portion 1 and snap on a different upper portion 1.

The present invention intends to reduce the cost of materials and production time. Since the raw materials and production energy are reduced during the production process of the present invention, environmental pollution is drastically reduced. Due to the multiple number of upper portions 1 which can be used with one standard sole 2, the present invention would reduce the production cost for the manufacturers, and the consumers are able to obtain a lower cost final product.

Although the invention has been explained in relation to its preferred embodiment, it is to be understood that many other possible modifications and variations can be made without departing from the spirit and scope of the invention as hereinafter claimed.

What is claimed is:

1. An apparatus for sandals with interchangeable upper section comprises, an upper portion;

a sole;

a securing system;

the upper portion comprises a first end, a second end, and a third end;

the sole comprises a top panel, an inside panel, an outside panel, front portion, and a back portion;

the securing system comprises a plurality of male connectors and a plurality of female connectors;

the plurality of male connectors and the plurality of female connectors being positioned in between the upper portion and the sole;

the upper portion being attached to the sole by the plurality of male connectors and the plurality of female connectors;

the first end being positioned in between the second end and the third end;

the first end being adjacently located with the front portion and the top panel;

the second end being oppositely positioned from the third end;

the second end and the third end being adjacently located with the back portion and the top panel;

the top panel being perpendicularly positioned with the inside panel and the outside panel;

the inside panel and the outside panel being oppositely positioned from each other;

the plurality of female connectors comprises a first female connector, a second female connector, and a third female connector;

the first female connector being adjacently connected with the first end;

the second female connector being adjacently connected with the second end;

the third female connector being adjacently connected with the third end;

the plurality of male connectors comprises a first male connector, a second male connector, and a third connector;

the first male connector being positioned on the front portion;

the first male connector being connected on the top panel;

the second male connector and the third male connector being positioned in the back portion;

the second male connector being connected with the top panel; and the third male connector being connected with the top panel.

2. The apparatus for sandals with interchangeable upper section as claimed in claim 1 comprises, the first female connector being traversed into the first male connector;

the second female connector being traversed into the second male connector; and the third female connector being traversed into the third male connector.

3. An apparatus for sandals with interchangeable upper section comprises, an upper portion;

a sole;

a securing system;

the upper portion comprises a first end, a second end, and a third end;

the sole comprises a top panel, an inside panel, an outside panel, front portion, and a back portion;

the securing system comprises a plurality of male connectors and a plurality of female connectors;

the plurality of male connectors and the plurality of female connectors being positioned in between the upper portion and the sole;

the upper portion being attached to the sole by the plurality of male connectors and the plurality of female connectors;

the first end being positioned in between the second end and the third end;

the first end being adjacently located with the front portion and the top panel;

the second end being oppositely positioned from the third end;

the second end being adjacently located with the back portion and the inside panel;

the third end being adjacently located with the back portion and the outside panel;

the plurality of female connectors comprises a first female connector, a second female connector, and a third female connector;

the first female connector being adjacently connected with the first end;

the second female connector being adjacently connected with the second end;

the third female connector being adjacently connected with the third end;

the plurality of male connectors comprises a first male connector, a second male connector, and a third connector;

the first male connector being positioned on the front portion;

the first male connector being connected on the top panel;

the second male connector and the third male connector being positioned in the back portion;

the second male connector being connected with the inside panel;

the third male connector being connected with the outside panel;

the first female connector being traversed into the first male connector;

the second female connector being traversed into the second male connector; and the third female connector being traversed into the third male connector.

4. The apparatus for sandals with interchangeable upper section as claimed in claim 3 comprises, the top panel being perpendicularly positioned with the inside panel and the outside panel; and the inside panel and the outside panel being oppositely positioned from each other.

5. An apparatus for sandals with interchangeable upper section comprises, an upper portion;

a sole;

a securing system;

the upper portion comprises a first end, a second end, and a third end;

the sole comprises a top panel, an inside panel, an outside panel, front portion, and a back portion;

the securing system comprises a plurality of male connectors and a plurality of female connectors;

the plurality of male connectors and the plurality of female connectors being positioned in between the upper portion and the sole;

the upper portion being attached to the sole by the plurality of male connectors and the plurality of female connectors;

the plurality of female connectors comprises a first female connector, a second female connector, and a third female connector;

the first female connector being adjacently connected with the first end;

the second female connector being adjacently connected with the second end;

the third female connector being adjacently connected with the third end;

the plurality of male connectors comprises a first male connector, a second male connector, and a third connector;

the first male connector being positioned on the front portion;

the first male connector being connected on the top panel;

the second male connector and the third male connector being positioned in the back portion;

the second male connector being connected with the top panel;

the third male connector being connected with the top panel;

the first female connector being traversed into the first male connector;

the second female connector being traversed into the second male connector; and the third female connector being traversed into the third male connector.

6. The apparatus for sandals with interchangeable upper section as claimed in claim 5 comprises, the first end being positioned in between the second end and the third end;

the first end being adjacently located with the front portion and the top panel;

the second end being oppositely positioned from the third end;

the second end and the third end being adjacently located with the back portion and the top panel;

the top panel being perpendicularly positioned with the inside panel and the outside panel; and the inside panel and the outside panel being oppositely positioned from each other.

* * * * *